US006491728B2

(12) United States Patent
Bacon et al.

(10) Patent No.: US 6,491,728 B2
(45) **Date of Patent: *Dec. 10, 2002**

(54) DETERGENT COMPOSITIONS CONTAINING ENDURING PERFUME

(75) Inventors: Dennis Ray Bacon, Milford; Toan Trinh, Maineville, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/822,079

(22) Filed: Mar. 30, 2001

(65) Prior Publication Data

US 2002/0010105 A1 Jan. 24, 2002

Related U.S. Application Data

(63) Continuation of application No. 08/575,186, filed on Dec. 20, 1995, now abandoned, which is a continuation-in-part of application No. 08/326,456, filed on Oct. 20, 1994, now Pat. No. 5,500,164.

(51) Int. Cl.[7] ..... D06L 1/00; C11D 3/50; C11D 1/00

(52) U.S. Cl. ..... 8/137; 510/102; 510/276; 510/337; 510/413; 510/414; 510/421; 510/426; 510/440; 510/444; 510/447; 134/42

(58) Field of Search ..... 510/102, 276, 510/337, 413, 414, 421, 426, 440, 444, 447; 134/42; 8/137

(56) References Cited

U.S. PATENT DOCUMENTS

| | | | | | |
|---|---|---|---|---|---|
| 4,440,663 | A | * | 4/1984 | Boyer et al. | 252/174.11 |
| 4,701,278 | A | | 10/1987 | Fehr | |
| 4,741,856 | A | | 5/1988 | Taylor et al. | |
| 4,954,285 | A | * | 9/1990 | Wierenga et al. | 252/174.11 |
| 4,999,138 | A | | 3/1991 | Nebashi et al. | |
| 5,143,900 | A | | 9/1992 | Steltenkamp et al. | |
| 5,234,610 | A | | 8/1993 | Gardlik et al. | |
| 5,234,611 | A | | 8/1993 | Trinh et al. | |
| 5,482,635 | A | | 1/1996 | Behan et al. | |
| 5,500,137 | A | | 3/1996 | Bacon et al. | |
| 5,500,138 | A | | 3/1996 | Bacon et al. | |
| 5,500,154 | A | * | 3/1996 | Bacon et al. | 252/551 |
| 5,540,853 | A | | 7/1996 | Trinh et al. | |
| 5,554,588 | A | * | 9/1996 | Behan et al. | 512/1 |

FOREIGN PATENT DOCUMENTS

| | | | | |
|---|---|---|---|---|
| AU | 0648039 | | 4/1991 | |
| AU | 648039 | * | 4/1994 | C11D/3/50 |
| EP | 0524762 | | 1/1993 | |

OTHER PUBLICATIONS

Escher et al., "A Quantitative Study of Factors That Influence the Substantivity of Fragrance Chemicals on Laundered and Dried Fabrics", JAOCS, vol. 71, No. 1 (1/94).

Muller et al., "What Makes a Fragrance Substantive?", Givaudan–Roure Research Ltd., CH–6800, Dubendorf Switzerland Oct. 1992.

* cited by examiner

*Primary Examiner*—Yogendra N. Gupta
*Assistant Examiner*—Brian P. Mruk
(74) *Attorney, Agent, or Firm*—Jason Camp; C. Brant Cook; Steve W. Miller

(57) ABSTRACT

A detergent composition containing efficient enduring perfume composition is provided. Specifically, the detergent composition comprises: a perfume composition comprising at least about 70% of enduring perfume ingredients characterized by having boiling points, measured at the normal, standard pressure, of about 250° C. or higher, and an octanol/water partitioning coefficent P of about 1,000 or higher, i.e., having a logP, or calculated logP, of about 3 or higher. The perfume is substantially free of halogenated fragrance materials and nitromusks. The composition also contains from about 0.01% to about 95% of a detergent surfactant system, preferably containing anionic and/or nonionic detergent surfactants. The compositions can be in the form of granules, liquids, pastes, bars, etc.

25 Claims, No Drawings

DETERGENT COMPOSITIONS CONTAINING ENDURING PERFUME

CROSS REFERENCE TO RELATED APPLICATIONS

This patent application is a continuation of U.S. application Ser. No. 08/575,186 filed Dec. 20, 1995 abandoned by Bacon et al., which is a continuation-in-part of U.S. application Ser. No. 08/326,456 filed Oct. 20, 1994 by Bacon et al., now U.S. Pat. No. 5,500,164 issued Mar. 19, 1996.

FIELD OF THE INVENTION

The present invention generally relates to detergent compositions containing efficient enduring perfumes. These compositions contain naturally, and/or synthetically, derived perfumes which are substantive to fabrics. These compositions provide better perfume deposition on treated fabric, thus minimizing the perfume lost during the laundry processes. The detergent compositions of the invention can be formulated as liquids, granules, or laundry bar compositions.

BACKGROUND OF THE INVENTION

Perfume in cleaning products provides olfactory aesthetic benefit and serves as a signal of cleanliness. These are especially important functions of these products. Continuous efforts are made to find improvements in both delivery effectiveness and longevity on fabrics. During a cleaning process, a substantial amount of perfume is lost with the wash water and/or with the rinse water and/or in the subsequent drying. It is extremely important that any perfume provide the maximum effect with the minimum amount of material, and that the material be as safe and non-irritating as possible.

People skilled in the perfume art, usually by experience, have some knowledge of some particular perfume ingredients that are "substantive" and/or non-irritating. Substantive perfume ingredients are those odorous compounds that effectively deposit on fabrics in the cleaning process and are detectable on the subsequently dried fabrics by people with normal olfactory acuity. The knowledge of what perfume ingredients are substantive is spotty and incomplete.

The object of this invention is to provide cleaning compositions containing enduring perfumes which are effectively retained and remain on the laundry for a long lasting aesthetic benefit with minimum amount of material, and not lost and/or wasted in the cleaning, rinsing, and/or drying steps. It is also an object to provide perfumes that are non-irritating insofar as that is possible.

SUMMARY OF THE INVENTION

The present invention relates to laundry detergent compositions comprising perfumes that provide a long lasting aesthetic benefit with a minimum amount of material ("enduring perfume"). In its broadest aspect, the present invention is directed to a detergent composition containing an effective amount of an enduring perfume composition as defined herein, together with a surfactant system which provides detergent benefits. Numerous perfume formulations suitable for use in the detergent of the invention can be prepared from known perfume or fragrance ingredients as disclosed hereinafter.

As used herein, all percentages, ratios and proportions are by weight, unless otherwise specified and all numerical values are approximations. All documents including patents and publications cited herein are incorporated herein by reference.

The invention comprises detergent compositions containing enduring perfume and a method of laundering soiled fabrics. The method comprises the step of contacting the soiled fabrics with an aqueous medium containing an effective amount of a detergent composition as described herein. In various embodiments of the invention, granules, liquids, and laundry bar compositions suitable for handwashing soiled fabrics are provided.

DETAILED DESCRIPTION OF THE INVENTION

The present invention especially relates to detergent compositions preferably comprising, by weight of the composition:

(A) from about 0.001% to about 10%, preferably from about 0.005% to about 5%, more preferably from about 0.01% to about 3%, by weight of an enduring perfume composition and (B) from about 0.01% to about 95%, preferably from about 5% to about 85%, more preferably from about 3% to about 30%, and even more preferably from about 5% to about 22%, of a surfactant system.

A. Enduring Perfume Composition

Laundry detergent compositions in the art commonly contain perfumes to provide a good odor to the atmosphere during the laundry process and, especially, to the clean laundry. These conventional perfume compositions are normally selected mainly for their odor quality, with some consideration of substantivity.

Enduring perfume ingredients, as disclosed herein, can be formulated into laundry detergent compositions and are substantially deposited and remain on the laundry throughout any rinse and/or drying steps. These enduring perfume ingredients minimize the material wasted, while still providing the good aesthetics that the consumers value.

An enduring perfume ingredient is characterized by its boiling point (B.P.) and its octanol/water partitioning coefficient (P). The octanol/water partitioning coefficient of a perfume ingredient is the ratio between its equilibrium concentrations in octanol and in water. The perfume ingredients of this invention have a B.P., measured at the normal, standard pressure, of about 250° C. or higher, preferably more than about 260° C.; and an octanol/water partitioning coefficient P of about 1,000 or higher. Since the partitioning coefficients of the perfume ingredients of this invention have high values, they are more conveniently given in the form of their logarithm to the base 10, logP. Thus the perfume ingredients of this invention have logP of about 3 or higher, preferably more than about 3. 1, and even more preferably more than about 3.2.

The boiling points of many perfume ingredients are given in, e.g., "Perfume and Flavor Chemicals (Aroma Chemicals)," Steffen Arctander, published by the author, 1969, incorporated herein by reference.

The logP of many perfume ingredients has been reported; for example, the Pomona92 database, available from Daylight Chemical Information Systems, Inc. (Daylight CIS), Irvine, California, contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo ( cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

Thus, when a perfume composition which is composed of ingredients having a B.P. of about 250° C. or higher and a ClogP, or an experimental logP, of about 3 or higher, is used in a laundry detergent composition, the perfume is very effectively deposited on fabric, and remains substantive after the rinsing and drying steps. Also, surprisingly, these same perfume compositions are very mild to skin and are relatively non-irritating.

Table 1 gives some non-limiting examples of enduring perfume ingredients, useful in laundry detergent compositions of the present invention. The enduring perfume compositions of the present invention contain at least about 3 different enduring perfume ingredients, more preferably at least about 4 different enduring perfume ingredients, and even more preferably at least about 5 different enduring perfume ingredients. Furthermore, the enduring perfume compositions of the present invention contain at least about 70 wt, % of enduring perfume ingredients, preferably at least about 75 wt, % of enduring perfume ingredients, more preferably at least about 80 wt, % of enduring perfume ingredients, and even more preferably at least about 85 wt, % of enduring perfume ingredients. Laundry detergent compositions of the present invention contain from about 0.001% to about 10%, preferably from about 0.005% to about 5%, more preferably from about 0.01% to about 3%, and even more preferably from about 0.02% to about 2%, of an enduring perfume composition.

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., solubilizing or diluting some solid or viscous perfume ingredients to, e.g., improve handling and/or formulating, or stabilizing volatile ingredients, e.g., by reducing their vapor pressure. These materials are not counted in the definition/formulation of the enduring perfume compositions of the present invention.

Non-enduring perfume ingredients, which should be minimized in laundry treatment compositions of the present invention, are those having a B.P. of less than about 250° C., or having a logP (or ClogP) of less than about 3.0, or having both a B.P. of less than about 250° C. and a logP (or ClogP) of less than about 3.0. Table 2 gives some non-limiting examples of non-enduring perfume ingredients. In some particular laundry compositions, some non-enduring perfume ingredients can be used in small amounts, e.g., to improve product odor. However, to minimize waste, the enduring perfume compositions of the present invention contain less than about 30 wt, % of non-enduring perfume ingredients, preferably less than about 25 wt, % of non-enduring perfume ingredients, more preferably less than about 20 wt, % of non-enduring perfume ingredients, and even more preferably less than about 15 wt, % of non-enduring perfume ingredients

TABLE 1

Examples of Enduring Perfume Ingredients

| Perfume Ingredients | Approximate B.P. (° C.) (a) | ClogP |
|---|---|---|
| BP > 250° C. and ClogP > 3.0 | | |
| Allyl cyclohexane propionate | 267 | 3.935 |
| Ambrettolide | 300 | 6.261 |
| Amyl benzoate | 262 | 3.417 |
| Amyl cinnamate | 310 | 3.771 |
| Amyl cinnamic aldehyde | 285 | 4.324 |
| Amyl cinnamic aldehyde dimethyl acetal | 300 | 4.033 |
| iso-Amyl salicylate | 277 | 4.601 |
| Aurantiol | 450 | 4.216 |
| Benzophenone | 306 | 3.120 |
| Benzyl salicylate | 300 | 4.383 |
| para-tert-Butyl cyclohexyl acetate | +250 | 4.019 |
| iso-Butyl quinoline | 252 | 4.193 |
| beta-Caryophyllene | 256 | 6.333 |
| Cadinene | 275 | 7.346 |
| Cedrol | 291 | 4.530 |
| Cedryl acetate | 303 | 5.436 |
| Cedryl formate | +250 | 5.070 |
| Cinnamyl cinnamate | 370 | 5.480 |
| Cyclohexyl salicylate | 304 | 5.265 |
| Cyclamen aldehyde | 270 | 3.680 |
| Dihydro isojasmonate | +300 | 3.009 |
| Diphenyl methane | 262 | 4.059 |
| Diphenyl oxide | 252 | 4.240 |
| Dodecalactone | 258 | 4.359 |
| iso E super | +250 | 3.455 |
| Ethylene brassylate | 332 | 4.554 |
| Ethyl methyl phenyl glycidate | 260 | 3.165 |
| Ethyl undecylenate | 264 | 4.888 |
| Exaltolide | 280 | 5.346 |
| Galaxolide | +250 | 5.482 |
| Geranyl anthranilate | 312 | 4.216 |
| Geranyl phenyl acetate | +250 | 5.233 |
| Hexadecanolide | 294 | 6.805 |
| Hexenyl salicylate | 271 | 4.716 |
| Hexyl cinnamic aldehyde | 305 | 5.473 |
| Hexyl salicylate | 290 | 5.260 |
| alpha-Irone | 250 | 3.820 |
| Lilial (p-t-bucinal) | 258 | 3.858 |
| Linalyl benzoate | 263 | 5.233 |
| 2-Methoxy naphthalene | 274 | 3.235 |
| Methyl dihydrojasmone | +300 | 4.843 |
| gamma-n-Methyl ionone | 252 | 4.309 |
| Musk indanone | +250 | 5.458 |
| Musk ketone | MP = 137° C. | 3.014 |
| Musk tibetine | MP = 136° C. | 3.831 |
| Myristicin | 276 | 3.200 |
| Oxahexadecanolide-10 | +300 | 4.336 |
| Oxahexadecanolide-11 | MP = 35° C. | 4.336 |
| Patchouli alcohol | 285 | 4.530 |
| Phantolide | 288 | 5.977 |
| Phenyl ethyl benzoate | 300 | 4.058 |
| Phenylethylphenylacetate | 325 | 3.767 |
| Phenyl heptanol | 261 | 3.478 |
| Phenyl hexanol | 258 | 3.299 |
| alpha-Santalol | 301 | 3.800 |
| Thibetolide | 280 | 6.246 |
| delta-Undecalactone | 290 | 3.830 |
| gamma-Undecalactone | 297 | 4.140 |
| Vetiveryl acetate | 285 | 4.882 |
| Yara-yara | 274 | 3.235 |
| Ylangene | 250 | 6.268 |

(a) M.P. is melting point; these ingredients have a B.P. higher than 250° C.

TABLE 2

Examples of Non-Enduring Perfume Ingredients

| Perfume Ingredients | Approximate B.P. (° C.) | ClogP |
|---|---|---|
| BP < 250° C. and ClogP < 3.0 | | |
| Benzaldehyde | 179 | 1.480 |
| Benzyl acetate | 215 | 1.960 |
| laevo-Carvone | 231 | 2.083 |
| Geraniol | 230 | 2.649 |
| Hydroxycitronellal | 241 | 1.541 |
| cis-Jasmone | 248 | 2.712 |
| Linalool | 198 | 2.429 |
| Nerol | 227 | 2.649 |
| Phenyl ethyl alcohol | 220 | 1.183 |
| alpha-Terpineol | 219 | 2.569 |
| BP > 250° C. and ClogP < 3.0 | | |
| Coumarin | 291 | 1.412 |
| Eugenol | 253 | 2.307 |
| iso-Eugenol | 266 | 2.547 |
| Indole | 254 decompos | 2.142 |
| Methyl cinnamate | 263 | 2.620 |
| Methyl dihydrojasmonate | +300 | 2.275 |
| Methyl-N-methyl anthranilate | 256 | 2.791 |
| beta-Methyl naphthyl ketone | 300 | 2.275 |
| delta-Nonalactone | 280 | 2.760 |
| Vanillin | 285 | 1.580 |
| BP < 250° C. and ClogP > 3.0 | | |
| iso-Bornyl acetate | 227 | 3.485 |
| Carvacrol | 238 | 3.401 |
| alpha-Citronellol | 225 | 3.193 |
| para-Cymene | 179 | 4.068 |
| Dihydro myrcenol | 208 | 3.030 |
| Geranyl acetate | 245 | 3.715 |
| d-Limonene | 177 | 4.232 |
| Linalyl acetate | 220 | 3.500 |
| Vertenex | 232 | 4.060 |

The perfumes suitable for use in the detergent composition can be formulated from known fragrance ingredients and for purposes of enhancing environmental compatibility, the perfume is preferably substantially free of halogenated fragrance materials and nitromusks.

B. Detersive Surfactants

The detergent composition comprises from about 0.01% to about 95%, preferably from about 5% to about 85%, more preferably from about 3% to about 30%, and even more preferably from about 5% to about 22%, of a surfactant system. Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. All of these patents are incorporated herein by reference.

Of the surfactants, anionics and nonionics are preferred and anionics are most preferred. Such preferred anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and/or potassium salts of the mixtures of fatty acids derived from coconut oil and tallow, i.e., sodium and/or potassium tallow and/or coconut soap. If high sudsing is desired, the branched-chain $C_{10}$–$C_{16}$ soaps can be used.

Additional anionic surfactants which suitable for use herein include the water-soluble salts, preferably the alkali metal, ammonium and/or alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and/or ethanolamine alkyl sulfates, especially those obtained by sulfating the higher alcohols ($C_8$–$C_{18}$ carbon atoms) such as those produced by reducing the glycerides of tallow or coconut oil, including primary, branched-chain, and/or random $C_{10}$–$C_{20}$ alkyl sulfates ("AS") [Such alkyl sulfates include the $C_{10}$–$C_{18}$ secondary (2,3) alkyl sulfates of the formula $CH_3(CH_2)_x(CHOSO_3-M+)\ CH_3$ and $CH_3\ (CH_2)_y(CHOSO_3-M+)\ CH_2CH_3$ where x and (y+1) are integers of at least about 7, preferably at least about 9, and M is a water-solubilizing cation and/or, especially, sodium; unsaturated sulfates such as oleyl sulfate]; b) the sodium, potassium and ethanolamine alkyl polyethoxylate sulfates, e.g., the $C_{10}$–$C_{22}$ alkyl alkoxy sulfates ("AExS") particularly those in which the alkyl group contains from 10 to 18, preferably from 12 to 18 carbon atoms, and wherein the polyethoxylate chain contains from 1 to 15, preferably 1 to 7 ethoxylate moieties; and c) the sodium and potassium alkylbenzene sulfonates in which the alkyl group contains from about 9 to about 18 carbon atoms, in straight chain or branched chain configuration, e.g., those of the type described in U.S. Pat. Nos. 2,220,099 and 2,477,383. Other nonlimiting examples of surfactants useful herein include $C_{10}$–$C_{18}$ alkyl alkoxy carboxylates (especially the EO 1–5 ethoxycarboxylates), the $C_{10\text{-}18}$ glycerol ethers, the $C_{10}$-C18 alkyl polyglycosides and their corresponding sulfated polyglycosides, and $C_{12}$–$C_{18}$ alpha-sulfonated fatty acid esters. Especially valuable are linear straight chain alkylbenzene sulfonates in which the average number of carbon atoms in the alkyl group is from about 11 to 13, abbreviated as $C_{11\text{-}13}$ LAS.

The conventional nonionic surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxalates/propoxalates), can be used. Preferred nonionic surfactants are those of the formula $R^1(OC_2H4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol. Additional suitable nonionic surfactants include polyhydroxy fatty acid amides of the formula

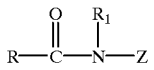

wherein R is a $C_{9\text{-}17}$ alkyl or alkenyl, $R_1$ is a methyl group and Z is glycityl derived from a reduced sugar or alkoxylated derivative thereof. Examples are N-methyl N-1-deoxyglucityl cocoamide, N-methyl N-1-deoxyglucityl oleamide, $C_{10}$–$C_{18}$ N-(3-methoxypropyl) glucamide, and the $C_{12}$–$C_{18}$ N-methylglucamides. See WO 9,206,154. The N-propyl through N-hexyl $C_{12}$–$C_{18}$ glucamides can be used for low sudsing. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference. Mixtures of anionic and nonionic surfactants are especially useful.

If desired, the conventional amphoteric surfactants such as the $C_{12}$–$C_{18}$ betaines and sulfobetaines ("sultaines"), $C_{10}$–$C_{18}$ amine oxides, and the like, can also be included in the overall compositions. Other conventional useful surfactants are listed in standard texts.

The $C_{10}$–$C_{18}$ alkyl alkoxy sulfates ("AExS"; especially EO 1–7 ethoxy sulfates) and $C_{12}$–$C_{18}$ alkyl ethoxylates ("AE") are the most preferred for the detergents described herein.

C. Detergency Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic P-containing detergent builders include, but are not limited to, the alkali metal, ammonium and alkanolammonium salts of polyphosphates (exemplified by the tripolyphosphates, pyrophosphates, and glassy polymeric meta-phosphates) and/or phosphonates. In situations where phosphorus-based builders can be used, and especially in the formulation of bars used for hand-laundering operations, the various alkali metal phosphates such as the well-known sodium and/or potassium tripolyphosphates, pyrophosphates and/or orthophosphates can be used. Phosphonate builders such as ethane-l-hydroxy-1,1-diphosphonate and other known phosphonates (see, for example, U.S. Pat. Nos. 3,159,581; 3,213,030; 3,422,021; 3,400,148 and 3,422,137) can also be used. However, non-phosphate builders are required in some locales.

Examples of suitable nonphosphorus, inorganic builders include the silicates, borates phytic acid, carbonates (including bicarbonates and sesquicarbonates), sulfates, and aluminosilicates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Examples of silicate builders are the alkali metal silicates, particularly those having a $SiO_2$: $Na_2O$ ratio in the range 1.6:1 to 3.2:1. Also, crystalline layered silicates such as those discussed in Corkill et al, U. S. Pat. No. 4,605,509, incorporated herein by reference, are suitable for use in the detergent composition of the invention. Other layered sodium silicates are described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates can also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(zAlO_2)_y]xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as Zeolite A. Dehydrated zeolites (x=0–10) can also be used herein. Preferably, the aluminosilicate has a particle size of about 0.1–10 microns in diameter.

Water-soluble, nonphosphorus organic builders useful herein include the various alkali metal, ammonium and/or substituted ammonium polyacetates, carboxylates, polycarboxylates and polyhydroxy sulfonates. A wide variety of polycarboxylate compounds are suitable. As used herein, "polycarboxylate" refers to compounds having a plurality of carboxylate groups, preferably at least 3 carboxylates. Polycarboxylate builders can generally be added to the composition in acid form, but can also be added in the form of a neutralized salt. When utilized in salt form, alkali metals, such as sodium, potassium, and lithium, or alkanolammonium salts are preferred.

Particularly preferred polycarboxylate builders the ether carboxylate builders. The ether polycarboxylates, including oxydisuccinate, are disclosed in, e.g., Berg, U.S. Pat. No. 3,128,287, issued Apr. 7, 1964, and Lamberti et al, U.S. Pat.

No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 3,308,067, Diehl, issued Mar. 7, 1967. See also Diehl U.S. Pat. No. 3,723,322. Still other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

D. Optional Ingredients

The compositions herein can optionally include one or more other detergent adjunct materials or other materials for assisting or enhancing cleaning performance, treatment of the substrate to be cleaned, or to modify the aesthetics of the detergent composition (e.g., colorants, dyes, etc.). The following are illustrative examples of such adjunct materials.

1. Cellulase Enzyme

Cellulase enzymes optionally used in the instant detergent composition are preferably incorporated, when present, at levels sufficient to provide up to about 5 mg by weight, more preferably about 0.01 mg to about 3 mg, of active enzyme per gram of the composition. Stated otherwise, the compositions herein preferably comprise from about 0.001% to about 5%, preferably 0.01%–1% by weight of a commercial enzyme preparation.

The cellulase suitable for the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander), suitable cellulases are also disclosed in GB-A-2.075.028; GB-A-2.095.275 and DE-OS-2.247.832. In addition, cellulase especially suitable for use herein are disclosed in WO 92-13057 (Procter & Gamble). Most preferably, the cellulases used in the instant detergent compositions are purchased commercially from NOVO Industries A/S under the product names CAREZYMEÒ and CELLUZYMEÒ.

2. Other Enzymes

Additional enzymes can be included in the formulations herein for a wide variety of fabric laundering purposes, including removal of protein-based, carbohydrate-based, or triglyceride-based stains, for example, and for the prevention of refugee dye transfer, and for fabric restoration. The additional enzymes to be incorporated include proteases, amylases, lipases, and peroxidases, as well as mixtures thereof. Other types of enzymes can also be included. They can be of any suitable origin, such as vegetable, animal, bacterial, fungal and yeast origin. However, their choice is governed by several factors such as pH-activity and/or stability optima, thermostability, stability versus active detergents, builders as well as their potential to cause malodors during use. In this respect bacterial or fungal enzymes are preferred, such as bacterial amylases and proteases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985); Protease B (see European Patent Application Serial No. 87303761.8, filed Apr. 28, 1987, and European Patent Application 130,756, Bott et al, published Jan. 9, 1985); and proteases made by Genencor International, Inc., according to one or more of the following patents: Caldwell et al, U.S. Pat. Nos. 5,185,258, 5,204,015 and 5,244,791.

Amylases include, for example, α-amylases described in British Patent Specification No. 1,296,839 (Novo), RAPIDASE®, International Bio-Synthetics, Inc. and TERMAMYL®, Novo Industries.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. *Chromobacter viscosum var. lipolyticum* NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli.* The LIPOLASE® enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Typical granular or powdered detergents can be stabilized effectively by using enzyme granulates. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

3. Enzyme Stabilizers

The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation can include a sufficient quantity of a water-soluble calcium ion source to provide such amounts in the laundry liquor. In the alternative, natural water hardness can suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein can also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

4. Bleaching Compounds—Bleaching Agents and Bleach Activators

The detergent compositions herein can optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Bums et al, filed Jun. 3, 1985, European Patent Application 0,133,354, Banks et al, published Feb 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Bums et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONEO®, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference.

Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1; Preferred examples of these catalysts include $Mn^{IV}{}_2(u\text{-}O)_3$ (1,4,7-trimethyl- 1,4,7-triazacyclononane)$_2(PF_6)_2$, $Mn^{III}{}_2(u\text{-}O)_1$ (u-OAc)$_2$(1,4,7-trimethyl- 1,4,7-triazacyclononane)$_2$.$(ClO_4)_2$, $Mn^{IV}{}_4(u\text{-}O)_6$(1,4,7-triazacyclononane)$_4(ClO_4)_4$, $Mn^{III}{}_{Mn}{}^{IV}{}_4(u\text{-}O)_1$ (u-OAc)$_2$(1,4,7-trimethyl- 1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

5. Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL® (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN® type of material, e.g., SOKALAN® HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON® 5126 (from DuPont) and MILEASE® T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters. Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

If utilized, soil release agents will generally comprise from about 0.01% to about 10.0%, by weight, of the detergent compositions herein, typically from about 0.1% to about 5%, preferably from about 0.2% to about 3.0%.

6. Chelating Agents

The detergent compositions herein can also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates. It is understood that some of the detergent builders described hereinbefore can function as chelating agents and is such detergent builder is present in a sufficient quantity, it can provide both functions.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

7. Clay Soil Removal/Anti-redeposition Agents

The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

8. Polymeric Dispersing Agents

Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers can also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents can also be used, especially in conjunction with zeolite builders. Dispersing agents such as polyaspartate preferably have a molecular weight (avg.) of about 10,000.

9. Brightener

Any optical brighteners or other brightening or whitening agents known in the art can be incorporated at levels typically from about 0.05% to about 1.2%, by weight, into the detergent compositions herein. Commercial optical brighteners which can be useful in the present invention can be classified into subgroups, which include, but are not necessarily limited to, derivatives of stilbene, pyrazoline, coumarin, carboxylic acid, methinecyanines, dibenzothiphene-5 ,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE® series of brighteners from Verona. Other brighteners disclosed in this reference include: Tinopal® UNPA, Tinopal CBS and Tinopal 5BM; available from Ciba-Geigy; Artic White® CC and Artic White CWD, available from Hilton-Davis, located in Italy; the 2-(4-stryl-phenyl)-2H-napthol [1 ,2-d]triazoles; 4,4'-bis- (1 ,2,3-triazol-2-yl)-stil- benes; 4,4'-bis(stryl) bisphenyls; and the aminocoumarins. Specific examples of these brighteners include 4-methyl-7-diethyl- amino coumarin; 1 ,2-bis(-venzimidazol-2-yl)ethylene; 1 ,3-diphenyl-phrazolines; 2,5-bis(benzoxazol-2-yl)thiophene; 2-stryl-napth- [1,2-d] oxazole; and 2-(stilbene-4-yl)-2H-naphtho-[1,2-d]triazole. See also U.S. Pat. No. 3,646,015, issued Feb 29, 1972 to Hamilton. Anionic brighteners are preferred herein.

10. Dye Transfer Inhibiting Agents

The compositions of the present invention can also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N→O group can be represented by the following general structures:

$$(R_1)_x—N\,[(R2)_y]\,[(R_3)_z]\rightarrow O \text{ and } =N\,[(R_1)_x]O$$

wherein $R_1$, $R_2$, $R_3$ are aliphatic, aromatic, heterocyclic or alicyclic groups or combinations thereof; x, y and z are 0 or 1; and the nitrogen of the N→O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also can employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein can also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners. It is understood that if the optical brightners discussed hereinbefore provide this benefit, then they can replace the optical brighteners discussed hereinafter.

The hydrophilic optical brighteners useful in the present invention are those having the structural formula:

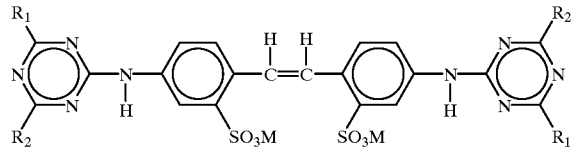

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the trade name Tinopal-UNPA-GX® by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'- stilbenedisulfonic acid disodium salt. This particular brightener species is commercially marketed under the trade name Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the trade name Tinopal AMS-GX® by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

11. Suds Suppressors

Compounds for reducing or suppressing the formation of suds can be incorporated into the compositions of the present invention. Suds suppression can be of particular importance in the so-called "high concentration cleaning process" and in front-loading European-style washing machines.

A wide variety of materials can be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein can also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about -40° C. and about 50° C., and a minimum boiling point not less than about 110° C. (atmospheric pressure). It is also known to utilize waxy hydrocarbons, preferably having a melting point below about 100° C.. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and U.S. Pat. No. 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC® L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL® 12. Mixtures of secondary alcohols are available under the trademark ISALCHEM® 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts can be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that can be utilized in combination with polyorganosiloxane, as well as any adjunct materials that can be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

12. Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

13. Other Ingredients

A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT® D1O, DeGussa) is admixed with a proteolytic enzyme solution containing 3%–5% of $C_{13-15}$ ethoxylated alcohol (EO 7) nonionic surfactant. Typically, the enzyme/surfactant solution is 2.5×the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photo activators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions can contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.5 and 10.5. Liquid dishwashing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

In order to make the present invention more readily understood, reference is made to the following examples, which are intended to be illustrative only and not intended to be limiting in scope.

Perfume A

| Perfume Ingredients | Approximate B.P. (° C.) | ClogP | Wt. % |
|---|---|---|---|
| Benzyl salicylate | 300 | 4.383 | 20 |
| Ethylene brassylate | 332 | 4.554 | 20 |
| Galaxolide - 50%[a] | +300 | 5.482 | 20 |
| Hexyl cinnamic aldehyde | 305 | 5.473 | 20 |
| Tetrahydro linalool | 191 | 3.517 | 20 |
| Total | | | 100 |

[a]A 50% solution in benzyl benzoate. Perfume A contains about 80% of enduring perfume components having BP > 250° C. and ClogP > 3.0.

Perfume B

| Perfume Ingredients | Approximate B.P. (° C.) | ClogP | Wt. % |
|---|---|---|---|
| Benzyl acetate | 215 | 1.960 | 4 |
| Benzyl salicylate | 300 | 4.383 | 12 |
| Coumarin | 291 | 1.412 | 4 |
| Ethylene brassylate | 332 | 4.554 | 10 |
| Galaxolide - 50%[a] | +300 | 5.482 | 10 |
| Hexyl cinnamic aldehyde | 305 | 4.853 | 20 |
| Lilial | 258 | 3.858 | 15 |
| Methyl dihydro isojasmonate | +300 | 3.009 | 5 |
| gamma-n-Methyl ionone | 252 | 4.309 | 10 |
| Patchouli alcohol | 283 | 4.530 | 4 |
| Tetrahydro linalool | 191 | 3.517 | 6 |
| Total | | | 100 |

[a]used as a 50% solution in isopropyl myristate which is not counted in the composition. Perfume B contains about 86% of enduring perfume components having BP > 250° C. and ClogP > 3.0.

Perfume C Woody Floral - Jasmin Type

| Ingredients | BP | ClogP | Wt. % |
|---|---|---|---|
| Amyl cinnamic aldehyde | 285 | 4.324 | 5 |
| iso-Amyl salicylate | 277 | 4.601 | 9 |
| Benzophenone | 306 | 3.120 | 2 |

-continued

Perfume C Woody Floral - Jasmin Type

| Ingredients | BP | ClogP | Wt. % |
|---|---|---|---|
| para-tert-Butyl cyclohexyl acetate | +250 | 4.019 | 10 |
| Cedrol | 291 | 4.530 | 3 |
| Cedryl formate | +250 | 5.070 | 1 |
| Hexyl cinnamic aldehyde | 305 | 5.473 | 14 |
| Linalyl benzoate | 263 | 5.233 | 1.5 |
| Methyl dihydrojasmonate | +300 | 4.843 | 10 |
| gamma-n-Methyl ionone | 252 | 4.309 | 8 |
| Musk indanone | +250 | 5.458 | 3 |
| Oxahexadecanolide-10 | +300 | 4.336 | 1 |
| Oxahexadecanolide-11 | MP = 35° C.(*) | 4.336 | 1 |
| Patchouli alcohol | 285 | 4.530 | 2 |
| Phenyl hexanol | 258 | 3.299 | 10 |
| Ylangene | 250 | 6.268 | 2 |
| Benzyl Acetate | 215 | 1.960 | 6 |
| Cis-Jasmone | 248 | 2.712 | 0.5 |
| Linalool | 198 | 2.429 | 6 |
| Linalyl acetate | 220 | 3.500 | 5 |
| Total | | | 100 |

(*) M.P. is melting point; this ingredient has a B.P. higher than 250° C.

Perfume D Fruity Floral

| Ingredients | BP | ClogP | Wt. % |
|---|---|---|---|
| Allyl cyclohexane propionate | 267 | 3.935 | 4 |
| Amyl benzoate | 262 | 3.417 | 2 |
| Amyl cinnamic aldehyde dimethyl acetal | 300 | 4.033 | 5 |
| Aurantiol | 450 | 4.216 | 3 |
| Dodecalactone | 258 | 4.359 | 3 |
| Ethylene brassylate | 332 | 4.554 | 5 |
| Ethyl methyl phenyl glycidate | 260 | 3.165 | 2 |
| Exaltolide | 280 | 5.346 | 5 |
| Galaxolide (50% in IPM) | +250 | 5.482 | 15 |
| Hexyl cinnamic aldehyde | 305 | 5.473 | 13 |
| Hexyl salicylate | 290 | 5.260 | 10 |
| iso E super | +250 | 3.455 | 8 |
| Lilial (p-t-bucinal) | 258 | 3.858 | 10 |
| gamma-Undecalactone | 297 | 4.140 | 3.5 |
| delta-Undecalactone | 290 | 3.830 | 0.5 |
| Allyl caproate | 185 | 2.772 | 3 |
| Fructone | — | — | 8 |
| Total | | | 100 |

Perfume E Floral

| Ingredients | BP | ClogP | Wt. % |
|---|---|---|---|
| Benzyl salicylate | 300 | 4.383 | 5 |
| iso-Butyl quinoline | 252 | 4.193 | 1 |
| beta-Caryophyllene | 256 | 6.333 | 1 |
| Cyclohexyl salicylate | 304 | 5.265 | 2 |
| Dihydro isojasmonate | +300 | 3.009 | 9 |
| Ethyl undecylenate | 264 | 4.888 | 2 |
| Galaxolide (50% in IPM) | +250 | 5.482 | 10 |
| Hexyl cinnamic aldehyde | 305 | 5.473 | 15 |
| Hexenyl salicylate | 271 | 4.716 | 1.9 |
| alpha-Irone | 250 | 3.820 | 0.1 |
| Lilial (p-t-bucinal) | 258 | 3.858 | 16 |
| Methyl dihydrojasmonate | +300 | 4.843 | 9 |
| 2-Methoxy naphthalene | 274 | 3.235 | 2 |
| Phenyl ethyl benzoate | 300 | 4.058 | 2 |
| Phenylethylphenylacetate | 325 | 3.767 | 2 |
| Tonalid | 248 | 6.247 | 4 |

-continued

Perfume E Floral

| Ingredients | BP | ClogP | Wt. % |
|---|---|---|---|
| Citronellol | 225 | 3.193 | 9 |
| Phenyl ethyl alcohol | 220 | 1.183 | 10 |
| Total | | | 100 |

Perfume F Rose Floral

| Ingredients | BP | ClogP | Wt. % |
|---|---|---|---|
| iso-Amyl salicylate | 277 | 4.601 | 10 |
| Benzophenone | 306 | 3.120 | 5 |
| Cyclamen aldehyde | 270 | 3.680 | 5 |
| Diphenyl oxide | 252 | 4.240 | 19 |
| Geranyl phenyl acetate | +250 | 5.233 | 1 |
| Hexyl cinnamic aldehyde | 305 | 5.473 | 10 |
| gamma-n-Methyl ionone | 252 | 4.309 | 5 |
| Lilial (p-t-bucinal) | 258 | 3.858 | 10 |
| Phenyl hexanol | 258 | 3.299 | 8 |
| Phenyl heptanol | 261 | 3.478 | 2 |
| Phenyl ethyl alcohol | 220 | 1.183 | 15 |
| alpha-Terpineol | 219 | 2.569 | 10 |
| Total | | | 100 |

Perfume G Woody Musk

| Ingredients | BP | ClogP | Wt. % |
|---|---|---|---|
| Ambrettolide | 300 | 6.261 | 5 |
| para-tert-Butyl cyclohexyl acetate | +250 | 4.019 | 10 |
| Cedrol | 291 | 4.530 | 10 |
| Exaltolide | 280 | 5.346 | 5 |
| Galaxolide (50% in IPM) | +250 | 5.482 | 15 |
| Hexadecanolide | 294 | 6.805 | 1 |
| gamma-n-Methyl ionone | 252 | 4.309 | 10 |
| iso E super | +250 | 3.455 | 8 |
| Musk indanone | +250 | 5.458 | 9 |
| Musk tibetine | MP = 136° C.(*) | 3.831 | 5 |
| Pachouli alcohol | 283 | 4.530 | 5 |
| Vetiveryl acetate | 285 | 4.882 | 5 |
| Methyl dihydrojasmonate | +300 | 2.420 | 6 |
| Cetalox | — | — | 1 |
| Coumarin | 291 | 1.412 | 5 |
| Total | | | 100 |

(*) M.P. is melting point; this ingredient has a B.P. higher than 250° C.

Perfume H Fruity Floral Powder

| Ingredients | BP | ClogP | Wt. % |
|---|---|---|---|
| Allyl cyclohexane propionate | 267 | 3.935 | 3 |
| Amyl cinnamic aldehyde dimethyl acetal | 300 | 4.033 | 8 |
| Aurantiol | ~300 | 4.216 | 3 |
| Cyclamen aldehyde | 270 | 3.680 | 5 |
| Cedryl acetate | 303 | 5.436 | 2 |
| Ethylene brassylate | 332 | 4.554 | 8 |
| Galaxolide (50% in IPM) | +250 | 5.482 | 5 |
| Hexyl cinnamic aldehyde | 305 | 5.473 | 12 |
| Hexyl salicylate | 290 | 5.260 | 5 |
| Lilial (p-t-bucinal) | 258 | 3.858 | 5 |

-continued

Perfume H Fruity Floral Powder

| Ingredients | BP | ClogP | Wt. % |
|---|---|---|---|
| Myristicin | 276 | 3.200 | 2 |
| Pachouli alcohol | 283 | 4.530 | 5 |
| Phenyl hexanol | 258 | 3.299 | 10 |
| Anisic Aldehyde | 248 | 1.779 | 1 |
| Benzoin Claire 50% in DEP | 344 | 2.380 | 3 |
| Cinnamic alcohol | 258 | 1.950 | 2 |
| Citral | 228 | 3.120 | 3 |
| Decyl aldehyde | 209 | 4.008 | 1 |
| Ethyl Vanillin | ~303 | 1.879 | 0.5 |
| Geranyl nitrile | 222 | 3.139 | 5 |
| Methyl dihydrojasmonate | ~300 | 2.420 | 3.5 |
| d-Limonene (Orange terpenes) | 177 | 4.232 | 8 |
| Total | | | 100 |

Perfume I Woody Powder Floral

| Ingredients | BP | ClogP | Wt. % |
|---|---|---|---|
| Amyl cinnamate | 310 | 3.771 | 5 |
| Amyl cinnamic aldehyde | 285 | 4.324 | 8 |
| para-tert-Butyl cyclohexyl acetate | +250 | 4.019 | 10 |
| Cadinene | 275 | 7.346 | 1 |
| Cedrol | 291 | 4.530 | 5 |
| Cinnamyl cinnamate | 370 | 5.480 | 5 |
| Diphenyl methane | 262 | 4.059 | 3 |
| Dodecalactone | 258 | 4.359 | 3 |
| Exaltolide | 280 | 5.346 | 2 |
| Geranyl anthranilate | 312 | 4.216 | 2 |
| Lilial (p-t-bucinal) | 258 | 3.858 | 3.5 |
| gamma-Methyl ionone | 252 | 4.309 | 5 |
| Musk indanone | +250 | 5.458 | 5 |
| Musk ketone | MP = 137° C. (*) | 3.014 | 0.5 |
| Musk tibetine | MP = 136° C. (*) | 3.831 | 3 |
| beta-Naphthol methyl ether (yara-yara) | 274 | 3.235 | 2 |
| Pachouli alcohol | 283 | 4.530 | 4 |
| Phantolide | 288 | 5.977 | 5 |
| alpha-Santalol | 301 | 3.800 | 3 |
| Ethyl cinnamate | 271 | 2.990 | 1 |
| Hexyl cinnamic aldehyde | 305 | 5.473 | 10 |
| Anisic Aldehyde | 248 | 1.779 | 0.5 |
| Linalyl acetate | 220 | 3.500 | 2 |
| Linalool | 198 | 2.429 | 2 |
| Methyl anthranilate | 237 | 2.024 | 0.5 |
| Benzoin Claire 50% in DEP | 344 | 2.380 | 4 |
| Ethyl Vanillin | ~303 | 1.879 | 1 |
| Methyl cinnamate | 263 | 2.620 | 1 |
| Vanillin | 285 | 1.275 | 3 |
| Total | | | 100 |

(*) M.P. is melting point; these ingredients have a B.P. higher than 250° C.

EXAMPLE I

This Example illustrates heavy duty granular detergents containing the above perfume formulations. The ingredients in the typical granular detergents exemplified herein are set forth in Table I below.

TABLE I

| Base Formula | (% weight ) 1 | 2 | 3 |
|---|---|---|---|
| $C_{12-13}$ linear alkylbenzene sulfonate (Na) | 9.0 | 9.0 | 9.0 |
| $C_{14-15}$ alkyl ethoxy (EO = 0.6) sulfate (Na) | 1.6 | 1.6 | 1.6 |
| $C_{12-18}$ alkyl sulfate | 5.7 | 5.7 | 5.7 |
| Polyacrylate (MW = 4500) | 3.2 | 3.2 | 3.2 |
| Aluminosilicate | 26.3 | 26.3 | 26.3 |
| Sodium silicate | 0.6 | 0.6 | 0.6 |
| Sodium carbonate | 27.9 | 27.9 | 27.9 |
| Sodium sulfate | 8.9 | 8.9 | 8.9 |
| Optical Brightener | 0.2 | 0.2 | 0.2 |
| Polyethylene glycol (MW = 4000) | 1.7 | 1.7 | 1.7 |
| Admix | | | |
| Perborate | 1.0 | 1.0 | 1.0 |
| Cellulase[1] (5 CEVU/g) | 0.6 | 0.6 | 0.6 |
| Protease[2] (.0062 AU/g) | 0.3 | 0.3 | 0.3 |
| Lipase[3] (206 LU/l) | 0.2 | 0.2 | 0.2 |
| Nonionic | 3.0 | 3.0 | 3.0 |
| Spray-on | | | |
| Perfume A | 0.4 | — | — |
| Perfume B | — | 0.4 | 0.4 |
| Misc. (water and other minors) | 9.4 | 9.4 | 9.4 |
| | 100.0 | 100.0 | 100.0 |

[1]CAREZYME[a] commercially sold by NOVO Industries A/S.
[2]Protease enzyme made by Genenecor International Inc. according to Caldwell et al, U.S. Pat. No. 5,185,258.
[3]LIPOLASE[a] commercially sold by NOVO Industries A/S.

The base formula illustrated herein can be made via a variety of known processes including conventional spray drying techniques or agglomeration in apparatus such as powder mixers and fluid beds commercially available from Lödige and Aeromatic, respectively. Agglomeration is especially suitable for preparing modem compact granular detergents and entails initially forming a surfactant paste using standard mixers, after which the paste is agglomerated into agglomerates and dried. Such processing techniques are well known in the art. The enzymes such as cellulase are dry mixed into the base formula and the perfumes used herein are subsequently sprayed onto the base formula so as to form the final granular detergent compositions exemplified herein.

The same base formula is prepared with Perfumes C–I replacing Perfumes A and B in each of the formulas.

EXAMPLE II

This Example illustrates liquid laundry detergent compositions containing the perfumes described above. Table II illustrates the various ingredients of the liquid laundry detergent.

TABLE II

| Component | (% weight) 4 | 5 | 6 |
|---|---|---|---|
| $C_{14-15}$ alkyl ethoxy (EO = 2.25) sulfate | 18.0 | 18.0 | 18.0 |
| N-Methyl N-1-Deoxyglucityl cocoamide | 5.0 | 5.0 | 5.0 |
| Nonionic[1] | 2.0 | 2.0 | 2.0 |
| Citric Acid | 3.0 | 3.0 | 3.0 |
| Oleic acid | 2.0 | 2.0 | 2.0 |
| Ethanol | 3.2 | 3.2 | 3.2 |
| Boric acid | 3.5 | 3.5 | 3.5 |
| Monoethanolamine | 1.1 | 1.1 | 1.1 |
| 1,2 Propanediol | 8.0 | 8.0 | 8.0 |

TABLE II-continued

| Component | (% weight) 4 | 5 | 6 |
|---|---|---|---|
| Sodium cumene sulfate | 3.0 | 3.0 | 3.0 |
| Sodium hydroxide | 3.8 | 3.8 | 3.8 |
| Polyacrylate | 1.2 | 1.2 | 1.2 |
| Protease[2] (.0145 AU/g) | 0.3 | 0.3 | 0.3 |
| Lipase[3] (200 LU/l) | 0.3 | 0.3 | 0.3 |
| Cellulase[4] (7.5 CEVU) | 0.3 | 0.3 | 0.3 |
| Perfume A | 0.3 | — | — |
| Perfume B | — | 0.3 | 0.3 |
| Misc. (water, brighteners, etc.) | 45.0 | 45.0 | 45.0 |
| | 100.0 | 100.0 | 100.0 |

[1]Neodol 23-9 commercially available from Shell Oil Company
[2]Protease enzyme made by Genencor International, Inc. according to Caldwell et al, U.S. Pat. No. 5,185,258.
[3]LIPOLASE[a] commercially available from NOVO Industries A/S
[4]CAREZYME[a] commercially available from NOVO Industries A/S The same base formula is prepared with Perfumes C–I replacing Perfumes A and B in each of the formulas.

EXAMPLE III

This Example illustrates laundry bars containing a perfume in accordance with the invention. The laundry bars exemplified herein are prepared by standard extrusion processes so as to be suitable for handwashing soiled fabrics. Table III sets forth the various ingredients in the laundry bars.

TABLE III

| Component | (% weight) 7 | 8 | 9 |
|---|---|---|---|
| $C_{12-13}$ linear alkylbenzene sulfonate (Na) | 10.0 | 10.0 | 10.0 |
| $C_{14-15}$ alkyl sulfate (Na) | 6.0 | 6.0 | 6.0 |
| $C_{14-15}$ alkyl ethoxy (EO = 0.6) sulfate (Na) | 3.0 | 3.0 | 3.0 |
| Sodium tripolyphosphate | 7.0 | 7.0 | 7.0 |
| Sodium pyrophosphate | 7.0 | 7.0 | 7.0 |
| Sodium carbonate | 25.0 | 25.0 | 25.0 |
| Aluminosilicate (hydrated Zeolite A ~1.5$\mu$) | 5.0 | 5.0 | 5.0 |
| Carboxymethyl cellulose (Na) | 0.2 | 0.2 | 0.2 |
| Polyacrylate (MW = 1400) (Na) | 0.2 | 0.2 | 0.2 |
| Brightener | 0.2 | 0.2 | 0.2 |
| Protease[1] | 0.3 | 0.3 | 0.3 |
| Cellulase[2] | 0.3 | 0.3 | 0.3 |
| Lipase[3] | 0.3 | 0.3 | 0.3 |
| Perfume A | 0.4 | — | — |
| Perfume B | — | 0.4 | 0.4 |
| Misc. (water, fillers and other minors) | 35.1 | 35.1 | 35.1 |
| | 100.0 | 100.0 | 100.0 |

[1]Protease enzyme made by Genencor International, Inc. according to Caldwell et al, U.S, Pat. No. 5,105,258.
[2]CAREZYME[a] commercially sold by NOVO Industries A/S
[3]LIPOLASE[a] commercially sold by NOVO Industries A/S The same base formula is prepared with Perfumes C–I replacing Perfumes A and B in each of the formulas.

EXAMPLE IV

Several additional liquid detergent compositions are prepared. The formulation for these compositions are set forth in Table IV.

TABLE IV

Liquid Detergent Compositions

| Component | Wt. % A | B | C | D |
|---|---|---|---|---|
| $C_{12}$–$C_{15}$ Alkyl sulfate | — | 19.0 | 21.0 | — |
| $C_{12}$–$C_{15}$ Alkyl ethoxylated sulfate | 23.0 | 4.0 | 4.0 | 25.0 |
| $C_{12}$–$C_{14}$ N-methyl glucamide | 9.0 | 9.0 | 9.0 | 9.0 |
| $C_{12}$–$C_{14}$ Fatty alcohol ethoxylate | 6.0 | 6.0 | 6.0 | 6.0 |
| $C_{12}$–$C_{16}$ Fatty acid | 9.0 | 6.8 | 14.0 | 14.0 |
| Citric acid anhydrous | 6.0 | 4.5 | 3.5 | 3.5 |
| Diethylenetriaminepentaethylene phosphonic acid (DTPA) | 1.0 | 1.0 | 2.0 | 2.0 |
| Monoethanolamine | 13.2 | 12.7 | 12.8 | 11.0 |
| Propanediol | 12.7 | 14.5 | 13.1 | 10.0 |
| Ethanol | 1.8 | 1.8 | 4.7 | 5.4 |
| Enzymes (protease, lipase, cellulase) | 2.4 | 2.4 | 2.0 | 2.0 |
| Terephthalate-based polymer | 0.5 | 0.5 | 0.5 | 0.5 |
| Boric acid | 2.4 | 2.4 | 2.8 | 2.8 |
| 2-butyl-octanol | 2.0 | 2.0 | 2.0 | 2.0 |
| DC 3421 R(1) | 0.3 | 0.4 | 0.3 | 0.4 |
| FF 400 R(2) | | | | |
| Poly(4-vinylpyridine)-N-oxide (PVNO) | — | — | 0.5 | 0.5 |
| N-vinylpyrrolidone/N-vinylimidazole copolymer - MW 10,000 (PVPVI) | 0.3 | 0.3 | — | — |
| Tinopal UNPA-GX Brightener | 0.075 | 0.21 | — | — |
| Tinopal 5BM-GX Brightener | — | — | 0.21 | 0.075 |
| Perfume A | 0.1 | 0.2 | — | — |
| Perfume B | — | — | 0.15 | 0.14 |
| Water & minors | Balance to 100% | | | |

(1)DC 3421 is a silicone oil commercially available from Dow Corning.
(2)is a silicone glycol emulsifier available from Dow Corning.

The same base formula is prepared with Perfumes C–I replacing Perfumes A and B in each of the formulas.

EXAMPLE V

Concentrated built heavy duty liquid detergent compositions are prepared having the formulations set forth in Table V.

TABLE V

Liquid Detergent Compositions

| Component | Wt. % A | B |
|---|---|---|
| $C_{14-15}$ Alkyl polyethoxylate (2.25) sulfonic acid | 23.00 | 12.50 |
| $C_{12-13}$ Linear alkyl benzene sulfonic acid | — | 11.46 |
| 1,2 Propanediol | 10.50 | 3.97 |
| Monoethanolamine | 12.50 | 3.65 |
| $C_{12-13}$ Alkyl polyethoxylate (6.5) | 6.00 | 1.78 |
| Ethanol | 3.80 | 1.75 |
| Polyhydroxy $C_{12-14}$ fatty acid amide | 9.00 | — |
| $C_{12-14}$ Coconut fatty acid | 9.00 | 2.60 |
| Citric acid | 6.00 | 6.04 |
| DTPA | 0.95 | — |
| Sodium formate | 0.14 | — |
| Boric acid | 2.4 | 1.0 |
| Tetraethylenepentaamine ethoxylate (15–18) | 1.00 | 1.44 |
| Soil release polymer | 0.46 | — |
| Enzymes (protease, lipase, cellulase) | 2.55 | 2.27 |
| Silicone antifoam composition | 0.04 | 0.02 |
| Poly(4-vinylpyridine)-N-oxide (PVNO) | 0.10 | 0.10 |
| Brightener - Tinopal UNPA-GX | 0.20 | 0.20 |
| Perfume A | 0.1 | — |
| Perfume B | — | 0.14 |
| Water and miscellaneous minors | Balance to 100% | |

The same base formula is prepared with Perfumes C–I replacing Perfumes A and B in each of the formulas.

EXAMPLE VI

Several compact granular detergent compositions are prepared. The formulations for these compositions are set forth in Table VI.

TABLE VI

Granular Detergent Compositions

| Component | Wt. % A | B | C |
|---|---|---|---|
| $C_{11}$–$C_{14}$ Linear alkyl benzene sulfonate | 11.40 | — | — |
| $C_{12}$ –$C_{15}$ Alkyl alkoxylated sulfate | — | 10.00 | — |
| $C_{12}$ –$C_{14}$ N-methyl glucamide | — | — | 13.00 |
| Tallow alkyl sulfate | 1.80 | 1.80 | 1.80 |
| $C_{45}$ alkyl sulfate | 3.00 | 3.00 | 3.00 |
| $C_{45}$ alcohol 7 times ethoxylated | 4.00 | 4.00 | 4.00 |
| Tallow alcohol 11 times ethoxylated | 1.80 | 1.80 | 1.80 |
| Dispersant | 0.07 | 0.07 | 0.07 |
| Silicone fluid | 0.80 | 0.80 | 0.80 |
| Trisodium citrate | 14.00 | 14.00 | 14.00 |
| Citric acid | 3.00 | 3.00 | 3.00 |
| Zeolite | 32.50 | 32.50 | 32.50 |
| Maleic acid acrylic acid copolymer | 5.00 | 5.00 | 5.00 |
| Cellulase (active protein) | 0.03 | 0.03 | 0.03 |
| Alkalase/BAN | 0.60 | 0.60 | 0.60 |
| Lipase | 0.36 | 0.36 | 0.36 |
| Sodium silicate | 2.00 | 2.00 | 2.00 |
| Sodium sulfate | 3.50 | 3.50 | 3.50 |
| Poly(4-vinylpyridine)-N-oxide (PVNO) | 0.10 | 0.10 | — |
| N-vinylpyrrolidone/N-vinylimidazole copolymer - MW 10,000 (PVPVI) | — | — | 0.20 |
| Brightener - Tinopal UNPA-GX | 0.20 | — | 0.20 |
| Brightener - Tinopal 5BM-GX | — | 0.20 | — |
| Perfume A | 0.1 | — | — |
| Perfume B | — | 0.2 | 0.14 |
| Misc. (water, minors, etc) | Balance to 100% | | |

The same base formula is prepared with Perfumes C–I replacing Perfumes A and B in each of the formulas.

EXAMPLE VII

A concentrated heavy duty granular detergent product is prepared having the composition set forth in Table VII.

TABLE VII

Compact Granular Detergent

| Component | Wt. % |
|---|---|
| $C_{14-15}$ Alkyl ethoxy sulfonic acid | 5.44 |
| $C_{12-13}$ Linear alkyl sulfonic acid | 12.70 |
| $C_{12-14}$ Alkyl ethoxylate | 0.50 |
| Alumino silicate (76%) | 25.40 |
| Polyacrylate | 3.12 |
| Tinopal UNPA-GX brightener | 0.27 |
| PEG-8000 (50%) | 1.53 |
| Silicone suds suppressor | 0.02 |
| Enzymes | 1.29 |
| Citric acid | 3.50 |
| Perborate | 2.00 |
| PVNO | 0.10 |
| Perfume B | 0.10 |
| Moisture/sodium sulfate/aesthetics/$NaCO_3$/minors, unreacted material | Balance to 100% |

The same base formula is prepared with Perfumes A and C–I replacing Perfume B in the formula.

The ingredients in the above Examples that are anionic, are present in their salt form, typically sodium.

Having thus described the invention in detail, it will be clear to those skilled in the art that various changes can be made without departing from the scope of the invention and the invention is not to be considered limited to what is described in the specification.

What is claimed is:

1. A detergent composition in the form of a liquid comprising:

(A) from about 0.001% to about 10% by weight of an enduring perfume composition consisting of perfume ingredients, wherein at least about 75% by weight of said perfume ingredients are enduring perfume ingredients having a ClogP of at least 3.0 and a boiling point of at least 250° C.; and (B) from about 0.01% to about 95% by weight of a surfactant system.

2. The composition of claim 1 wherein the enduring perfume composition is at a level of from about 0.005% to about 5% by weight.

3. The composition of claim 2 wherein the enduring perfume composition is at a level of from about 0.01% to about 3% by weight.

4. The composition of claim 1 wherein the level of surfactant is from about 5% to about 85%.

5. The composition of claim 4 wherein the enduring perfume composition is at a level of from about 0.005% to about 5% by weight.

6. The composition of claim 5 wherein the enduring perfume composition is at a level of from about 0.01% to about 3% by weight.

7. The composition of claim 1 wherein the level of surfactant is from about 3% to about 30%.

8. The composition of claim 7 wherein the level of surfactant is from about 5% to about 22%.

9. The composition of claim 7 wherein the enduring perfume composition is at a level of from about 0.005% to about 5% by weight.

10. The composition of claim 9 wherein the enduring perfume composition is at a level of from about 0.01% to about 3% by weight.

11. The composition of claim 1 in the form of a liquid and comprising a carrier selected from the group consisting of: water, $C_1$ –$C_4$ monohydric alcohols, $C_2$–$C_6$ polyhydric alcohols, liquid polyalkylene glycols, and mixtures thereof.

12. The composition of claim 1 wherein at least about 80% by weight of said perfume ingredients are enduring perfume ingredients having a ClogP of at least 3.0 and a boiling point of at least 250° C.

13. The composition of claim 1 wherein at least about 85% by weight of said perfume ingredients are enduring perfume ingredients having a ClogP of at least 3.0 and a boiling point of at least 250° C.

14. The composition of claim 13 wherein said surfactant system comprises an anionic detergent surfactant.

15. The composition of claim 1 wherein said surfactant system comprises an anionic detergent surfactant.

16. The composition of claim 15 wherein said surfactant system comprises at least about 50% anionic detergent surfactant.

17. The composition of claim 1 wherein said surfactant system comprises: a mixture of anionic and nonionic detergent surfactants.

18. The composition of claim 17 wherein the level of detergent surfactant is from about 1% to about 30%.

19. The composition of claim 18 wherein the level of said detergent surfactant is from about 12% to about 25% and said composition contains from about 0.05% to about 20% of surfactant that builds suds other than said detergent surfactant.

20. The composition of claim 1 wherein said enduring perfume ingredients are selected from the group consisting of: Allyl cyclohexane propionate; Ambrettolide; Amyl benzoate; Amyl cinnamate; Amyl cinnamic aldehyde; Amyl cinnamic aldehyde dimethyl acetal; iso-Amyl salicylate; Aurantiol; Benzophenone; Benzyl salicylate; para-tert-Butyl cyclohexyl acetate; iso-Butyl quinoline; beta-Caryophyllene; Cadinene; Cedrol; Cedryl acetate; Cedryl formate; Cinnamyl cinnamate; Cyclohexyl salicylate; Cyclamen aldehyde; Dihydro isojasmonate; Diphenyl methane; Diphenyl oxide; Dodecalactone; iso E super; Ethylene brassylate; Ethylmethyl phenyl glycidate, Ethyl undecylenate; Exaltolide; Galaxolide; Geranyl anthranilate; Geranyl phenyl acetate; Hexadecanolide; Hexenyl salicylate; Hexyl cinnamic aldehyde; Hexyl salicylate; alpha-Irone; Lilial (p-t-bucinal); Linalyl benzoate; 2-Methoxy naphthalene; Methyl dihydrojasmone; gamma-n-Methyl ionone; Musk indanone; Musk ketone; Musk tibetine; Myristicin; Oxahexadecanolide-10; Oxahexadecanolide-11; Patchouli alcohol; Phantolide; Phenyl ethyl benzoate; Phenylethylphenylacetate; Phenyl heptanol; Phenyl hexanol; alpha-Santalol; Thibetolide; delta-Undecalactone; gamma-Undecalactone; Vetiveryl acetate; yara-yara; Ylangene; and mixtures thereof.

21. The composition of claim 1 further comprising from about 1% to about 55% of a surfactant selected from the group consisting of: alkyl benzene sulfonates, alkyl ester sulfonates, alkyl ethoxylates, alkyl phenol alkoxylates, alkylpolyglucosides, alkyl sulfates, alkyl ethoxy sulfate, secondary alkyl sulfates and mixtures thereof.

22. The composition of claim 21 further comprising at least about 1% by weight of a detergency builder.

23. The composition of claim 22 further comprising adjunct ingredients selected from the group consisting of bleaches, bleach activators, suds suppressors, enzyme stabilizers, polymeric dispersing agents, dye transfer inhibitors, soil release agents and mixtures thereof.

24. The composition of claim 21 wherein said composition is in the form of agglomerates and the density of said detergent composition is at least about 650 g/l.

25. A method of laundering fabrics comprising the step of contacting said fabrics with an aqueous medium containing an effective amount of a detergent composition according to claim 1.

* * * * *

UNITED STATES PATENT AND TRADEMARK OFFICE

CERTIFICATE OF CORRECTION

PATENT NO. : 6,491,728 B2
DATED : December 10, 2002
INVENTOR(S) : Dennis Ray Bacon It is certified that error appears in the above-identified patent and that said Letters Patent is hereby corrected as shown below:

Title page,
Item [63], replace "No. 5,500,164" with -- No. 5,500,154 --.

Signed and Sealed this

Twenty-second Day of April, 2003

JAMES E. ROGAN
*Director of the United States Patent and Trademark Office*